US011206915B1

(12) United States Patent
Burns

(10) Patent No.: US 11,206,915 B1
(45) Date of Patent: Dec. 28, 2021

(54) FOLDABLE BROOM

(71) Applicant: Jeff Burns, Jonesboro, LA (US)

(72) Inventor: Jeff Burns, Jonesboro, LA (US)

( * ) Notice: Subject to any disclaimer, the term of this patent is extended or adjusted under 35 U.S.C. 154(b) by 139 days.

(21) Appl. No.: 16/663,544

(22) Filed: Oct. 25, 2019

(51) Int. Cl.
*A46B 5/00* (2006.01)

(52) U.S. Cl.
CPC ..... *A46B 5/0033* (2013.01); *A46B 5/0045* (2013.01); *A46B 5/0083* (2013.01)

(58) Field of Classification Search
CPC ..... A46B 5/00; A46B 5/0033; A46B 5/0041; A46B 5/0045; A46B 5/0083; A46B 7/023; A46B 7/026; B25G 1/06; B25G 1/104
See application file for complete search history.

(56) References Cited

U.S. PATENT DOCUMENTS 5,746,533 A * 5/1998 Schmidt ..... E05D 11/1007 16/319
5,943,727 A * 8/1999 Freer ..... A46B 5/0033 15/144.1
6,088,868 A 7/2000 Cerveny
2006/0200924 A1* 9/2006 Hampton ..... A46B 5/0033 15/144.3
2014/0053358 A1* 2/2014 Costa ..... A46B 5/0041 15/171
2016/0193490 A1* 7/2016 Chen ..... A63B 21/4035 482/126

* cited by examiner

*Primary Examiner* — Shay Karls
(74) *Attorney, Agent, or Firm* — Sanchelima & Associates, P.A.; Christian Sanchelima; Jesus Sanchelima

(57) ABSTRACT

A foldable broom including a head assembly and a broomstick assembly is disclosed. The broomstick assembly includes a handle having double hinge mechanisms thereon to allow the foldable broom to easily and quickly expand or collapse along the double hinge mechanisms to achieve an open or closed configuration respectively. The closed configuration allows the foldable broom to save space and easily be stored in smaller areas or locations.

8 Claims, 3 Drawing Sheets

FOLDABLE BROOM

BACKGROUND OF THE INVENTION

1. Field of the Invention

The present invention relates to a foldable broom and, more particularly, to a foldable broom that easily collapses and extends for ease of transporting or usage thereof.

2. Description of the Related Art

Several designs for brooms have been designed in the past. None of them, however, include two double hinge mechanisms to allow the broom handle to fold in multiple places to save space and further permit easier storage in smaller spaces. The double hinge mechanism further aids in quick assembly of the present invention for usage thereof.

Applicant believes that a related reference corresponds to U.S. patent No. 2014/0053358 for a portable broom. Applicant believes another related reference corresponds to U.S. Pat. No. 6,088,868 for a folding compact push broom. None of these references, however, teach of a double hinge mechanism that allows the broom handle to easily collapse or extend for storage or usage, respectively.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a foldable broom having a double hinge mechanism along the handle of the broom.

It is another object of this invention to provide a foldable broom that saves space.

It is still another object of the present invention to provide a foldable broom that can be collapsed for storage in smaller areas.

It in another object of the present invention to provide a foldable broom that can easily be operated to fold or extend for storage or usage by all users.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
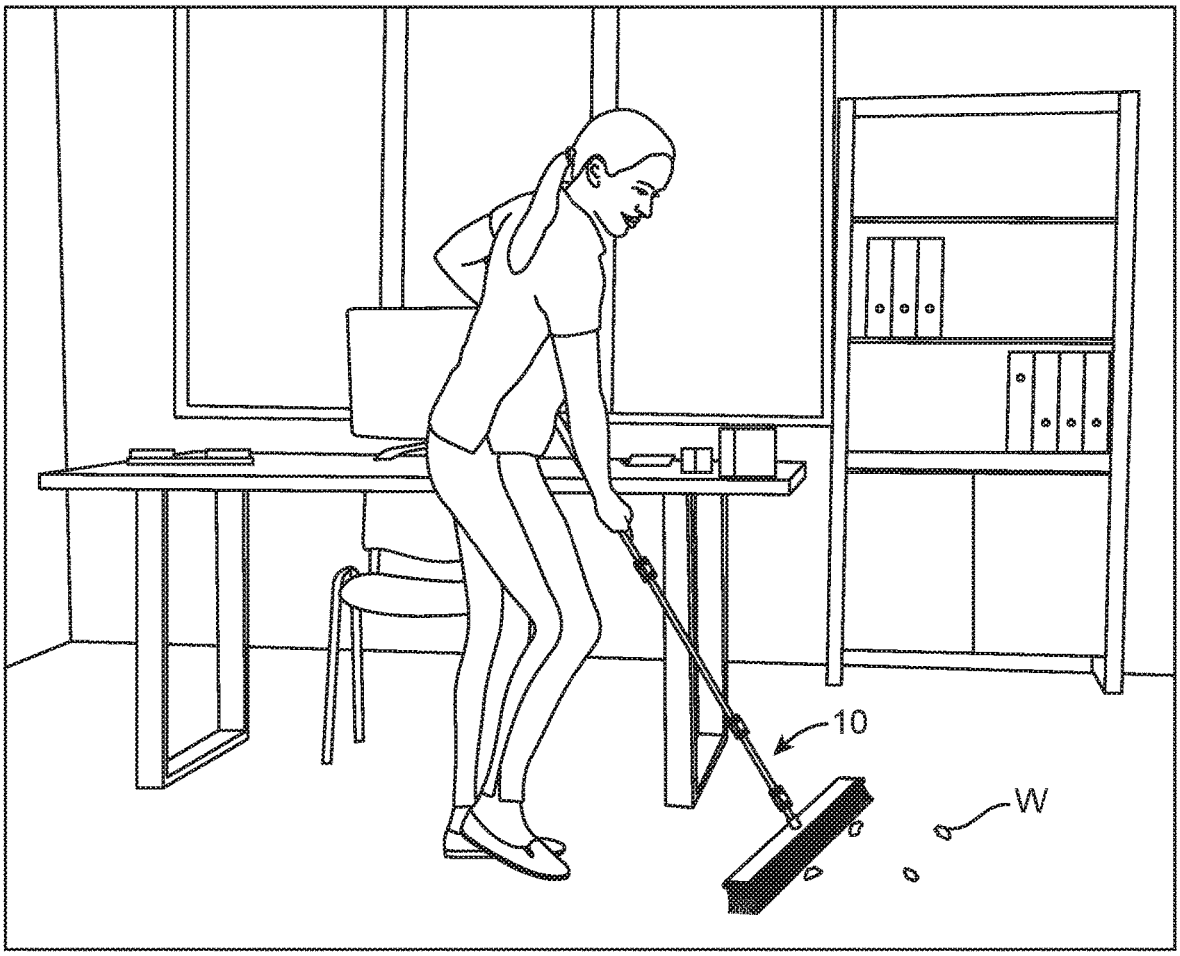
FIG. 1 represents the present invention in an operational setting in which a user is using the present invention for cleaning.
Figure 2:
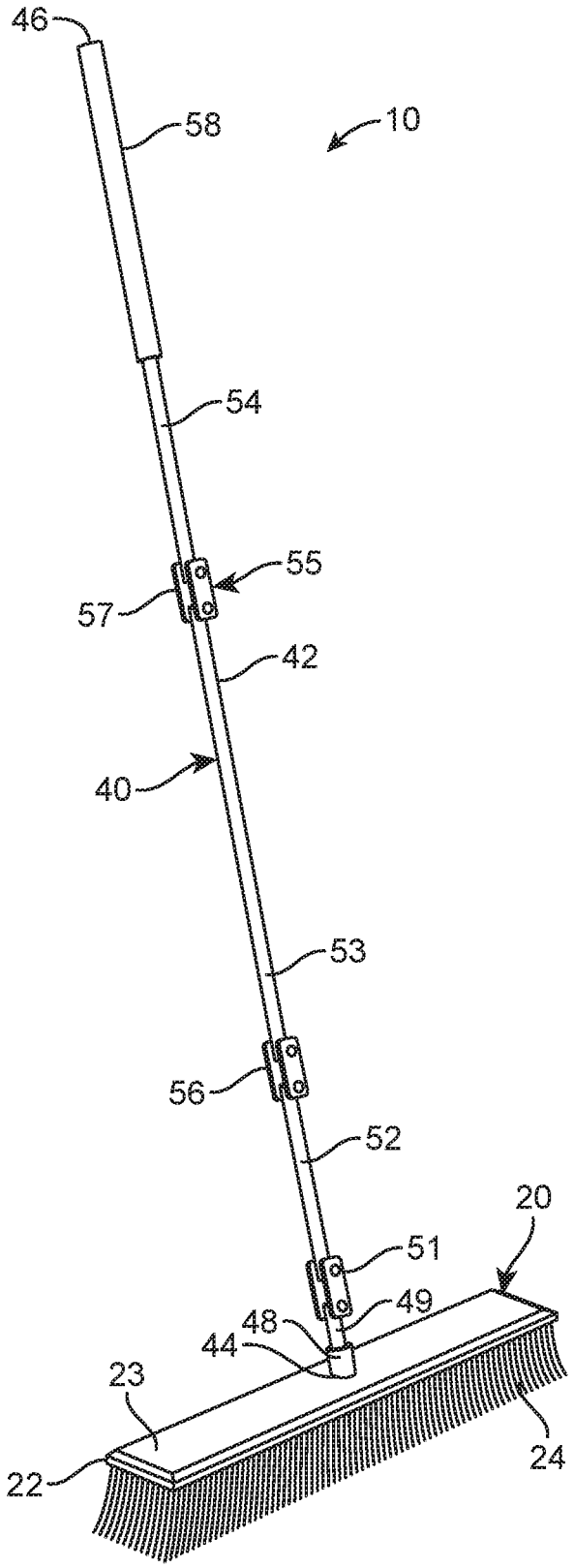
FIG. 2 shows the present invention expanded in an open configuration.
Figure 3:
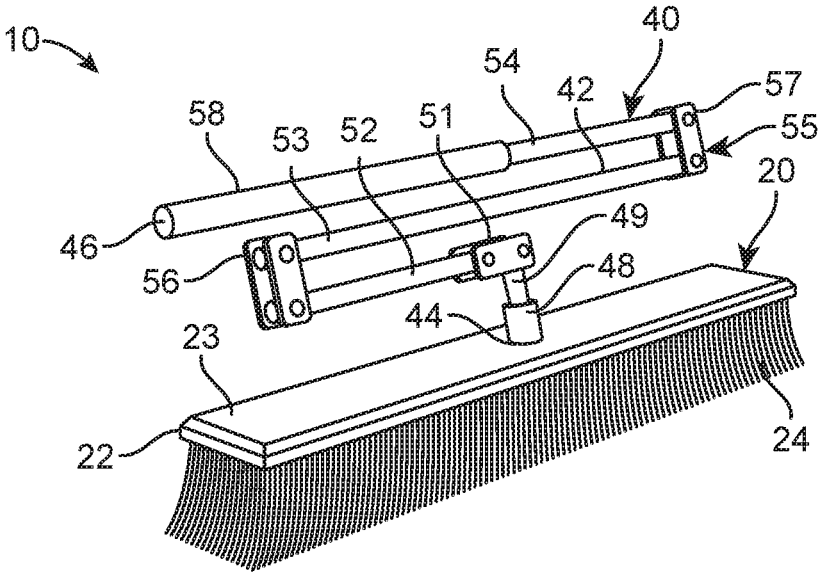
FIG. 3 illustrates the present invention collapsed in the closed configuration.
Figure 4:
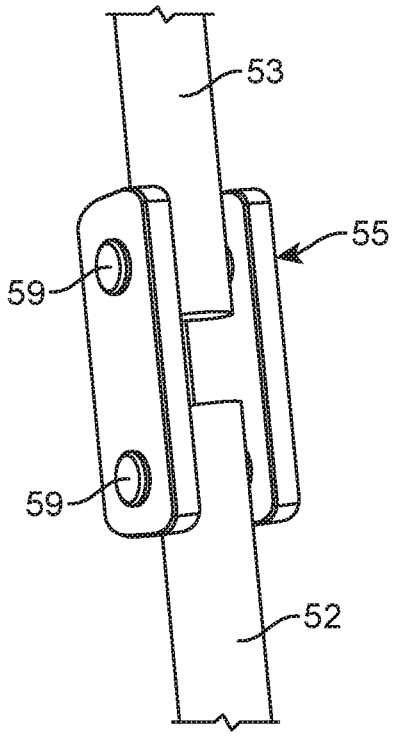
FIG. 4 is a zoomed in view of the double hinge mechanism that permits the present invention to expand and collapse to achieve the open and closed configuration, respectively.

Referring now to the drawings, where the present invention is generally referred to with numeral 10, it can be observed that it, a foldable broom 10, basically includes a head assembly 20 and a broomstick assembly 40.

It can be seen that foldable broom 10 has head assembly 20 which includes a broom head 22. In one embodiment, broom head 22 may be rectangular in shape. However, it should be understood that it may be suitable for broom head 22 to be virtually any shape that a user U desires. In one embodiment, broom head 22 may be made of wood. However, it should be understood that it may be suitable for broom head 22 to be made of plastic, aluminum, metal, rubber or the like in an alternate embodiment. In one embodiment, broom head 22 may include a top surface 23 which is smooth and has rounded corners. It may be preferable for broom head 22 to be made of a material that is light weight and durable. Mounted underneath broom head 22 may be bristles 24 of predetermined dimensions. It may be suitable for bristles 24 to extend a predetermined amount into broom head 22 at a bottom surface thereof. Bristles 24 may be roughly parallel to one another. Bristles 24 may preferably be made of stiff fibers. It may be suitable for bristles 24 to be made of wood, straw, twine, plastic, hair corn husks or the like as known in the art. Bristles 24 may be used to push waste W around and together for easier collection thereof.

Foldable broom 10 may further include a broomstick assembly 40 mounted thereon head assembly 20. Broomstick assembly 40 may include a handle 42 having a first end 44 and a second end 46. Handle 42 may be of a predetermined shape and dimension. In one embodiment, handle 42 may be cylindrical shaped. Handle 42 may expand and collapse and as such handle 42 has an open configuration and a closed configuration. Handle 42 may be mounted to top surface 23 of broom head 22 at first end 44 thereof. Handle 42 may include a female member 48 centrally located on top surface 23 of broom head 22, having a male member 49 mounted therein. Female member 48 and male member 49 provide stability to handle 42 as it is mounted to broom head 22. Male member 49 may be mounted to female member 48 on one end and a hinge 51 on an opposite end thereof with fasteners 59 extending therethrough. Fasteners 59 should extend through hinge 51 entirely on an upper and lower portion thereof. In both the open and closed configuration, female member 48 and male member 49 remain vertical. Handle 42 further includes a first collapsible portion 52, a second collapsible portion 53 and a third collapsible portion 54. Handle 42 may also include a double hinge mechanism 55 having a first double hinge 56 and a second double hinge 57. First collapsible portion 52 may be mounted to hinge 51 with fasteners 59 at a lower portion of first collapsible portion 52. First collapsible portion 52 may extend until first double hinge 56 is reached. At an upper portion of first collapsible portion 52 first double hinge 56 may be mounted thereto with fasteners 59. At an opposite end of first double hinge 56 may be mounted a lower portion of second collapsible portion 53. Second collapsible portion 53 may extend until second double hinge 57 is reached. An upper portion of second collapsible hinge 53 may be mounted thereto second double hinge 57 with fasteners 59 extending therethrough. At an opposite end of second double hinge 57 may be mounted a lower portion of third collapsible portion 54. It should be understood that each of first collapsible portion 52, second collapsible portion 53 and third collapsible portion 54 may be of predetermined dimensions and shape. A grip 58 may be mounted at second end 46 of handle 42. Grip 58 may be provided in order to provide comfort to a person handling and operating the present invention. Grip 58 may be of a material such as plastic, rubber or the like. In one embodiment, grip 58 may be made of an antibacterial material or sweat wicking material. Grip 58 may be adapted to conform to the hand of a person who grasps grip 58. More specifically, third collapsible portion 54 may include grip 58 mounted thereon. Grip 58 may extend a predetermined length of third collapsible portion 54. In one embodiment, grip 58 may extend substantially over half of third collapsible portion 54. In the open configuration, broomstick assembly 40 may be mounted entirely perpendicularly to head assembly 20. In the open configuration, female member 48, male member 49, hinge 51, first collapsible portion 52, second collapsible portion 53, third collapsible portion 54, first double hinge 56 and second double hinge 57 may be vertically in line with one another, meaning on one same plane. In the closed configuration, female member 48, male member 49, first double hinge 56 and second double hinge 57 remain vertical. In the closed configuration, first collapsible portion 52, second collapsible portion 53 and third collapsible portion 54 become horizontal. It should be understood that grip 58 has the same orientation as third collapsible portion 54 at all times.

It should be understood that the present invention may be of predetermined dimensions. However, in the immediate embodiment, first collapsible portion 52 may be shorter than second collapsible portion 53 and third collapsible portion 54. Second collapsible portion 53 may be shorter than third collapsible portion 54. Third collapsible portion 54 may be the longest in comparison. As such, in the closed configuration, collapsible portions are seen extending beyond the length of the preceding collapsible portion. In the closed configuration, first collapsible portion 52, second collapsible portion 53 and third collapsible portion 54 are parallel to each other. In the closed configuration, hinge 51 may also be parallel to first collapsible portion 52, second collapsible portion 53 and third collapsible portion 54. In the closed configuration, first double hinge 56 and second double hinge 57 may remain vertical, but first double hinge 56 and second double hinge 57 will then be parallel to each other.

It should be understood that when user U would like to operate the present invention then the present invention and more specifically, broom assembly 40, should be in the open configuration to sweep or clean with the present invention. Once user U would like to store or transport the present invention then the present invention and more specifically, broom assembly 40, are put into the closed configuration. In the closed configuration, the present invention can be easily transported or stored in small areas. The present invention allows for cleaning as known with a broom or the like. It should be understood, that the present invention nor any of components thereof should be limited in shape, dimension, color or material. The present invention should be lightweight and durable.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a foldable broom, comprising:

a) a head assembly including a flat broom head, said flat broom head having bristles mounted underneath said flat broom head, wherein the flat broom head has a substantially rectangular profile shape and rounded corners of a top surface;

b) broomstick assembly including a handle and a double hinge mechanism, a first double hinge and a second double hinge, having two opposing rectangular plates with rounded corners and tapered edges and joined by fasteners, said broomstick assembly having a retracted and extended configuration, said handle having a first end and a second end, said handle including a female member with substantially cylindrical shape, at said first end, centrally mounted on said top surface of said flat broom head, said female member having a male member with a substantially cylindrical shape, mounted thereto extending vertically to a hinge, a first collapsible portion extends therefrom said hinge at an opposite end thereof, said first collapsible portion extending until it is received by the first double hinge, said first double hinge having a second collapsible portion extending therefrom, said second collapsible portion extending vertically until said second double hinge is reached, said second double hinge having a third collapsible portion extending therefrom;

c) said handle has a grip mounted thereon said second end on said third collapsible portion, wherein the grip is hollow and has a substantially cylindrical shape, said grip extends substantially to half of said third collapsible portion, the grip is made of an antibacterial and sweat wicking material, wherein said material is rubber; and d) said third collapsible portion being greater in length than said first collapsible portion and said second collapsible portion, said second collapsible portion being greater in length than said first collapsible portion, said first collapsible portion being greater in length than said male member.

2. The foldable broom of claim 1, wherein said female member, said male member, said hinge, said first collapsible portion, said second collapsible portion, said third collapsible portion and said double hinge mechanism are axially aligned when said broom assembly is in said extended configuration, thereby forming a T-shape with said head assembly.

3. The foldable broom of claim 1, wherein said first collapsible portion, said second collapsible portion and said third collapsible portion are parallel to said top surface of said head assembly in said retracted configuration.

4. The foldable broom of claim 1, wherein said first double hinge and said second double hinge are perpendicular to said first collapsible portion, said second collapsible portion and said third collapsible portion in said retracted configuration.

5. The foldable broom of claim 1, wherein said fasteners mount and secure said male member and said first collapsible portion to said hinge.

6. The foldable broom of claim 1, wherein said fasteners mount and secure said first collapsible portion and said second collapsible portion to said first double hinge.

7. The foldable broom of claim 1, wherein said fasteners mount said second collapsible portion and said third collapsible portion to said second double hinge.

8. A system for a foldable broom, comprising:

a) a head assembly including a flat broom head, said flat broom head having bristles mounted underneath said flat broom head, wherein the flat broom head has a substantially rectangular profile shape and rounded corners of a top surface;

b) broomstick assembly including a handle and a double hinge mechanism, a first double hinge and a second double hinge, having two opposing rectangular plates with rounded corners and tapered edges and joined by fasteners, said broomstick assembly having a retracted and extended configuration, said handle having a first end and a second end, said handle including a female member with substantially cylindrical shape, at said first end, centrally mounted on said top surface of said flat broom head, said female member having a male member with a substantially cylindrical shape, mounted thereto extending vertically to a hinge, a first collapsible portion extends therefrom said hinge at an opposite end thereof, said first collapsible portion extending until it is received by the first double hinge, said first double hinge having a second collapsible portion extending therefrom;

c) said second collapsible portion extending vertically until said second double hinge is reached, said second double hinge having a third collapsible portion extending therefrom; said handle has a grip mounted thereon said second end on said third collapsible portion, wherein the grip is hollow and has a substantially cylindrical shape, said grip extends substantially to half of said third collapsible portion, the grip is made of an antibacterial and sweat wicking material, wherein said material is rubber;

d) said third collapsible portion being greater in length than said first collapsible portion and said second collapsible portion, said second collapsible portion being greater in length than said first collapsible portion, said first collapsible portion being greater in length than said male member;

e) said female member, said male member, said hinge, said first collapsible portion, said second collapsible portion, said third collapsible portion and said double hinge mechanism are axially aligned when said broom assembly is in said extended configuration, thereby forming a T-shape with said head assembly;

f) said first collapsible portion, said second collapsible portion and said third collapsible portion are parallel to said top surface of said head assembly in said retracted configuration;

g) said first double hinge and said second double hinge perpendicular to said first collapsible portion, said second collapsible portion and said third collapsible portion in said retracted configuration;

h) said fasteners mount and secure said male member and said first collapsible portion to said hinge;

i) said fasteners mount and secure said first collapsible portion and said second collapsible portion to said first double hinge; and j) said fasteners mount said second collapsible portion and said third collapsible portion to said second double hinge.

* * * * *